United States Patent [19]

Kobayashi

[11] Patent Number: 4,728,105

[45] Date of Patent: Mar. 1, 1988

[54] GOLF CLUB HEAD

[75] Inventor: Masashi Kobayashi, Matsudo, Japan

[73] Assignee: Maruman Golf Co., Ltd., Tokyo, Japan

[21] Appl. No.: 922,964

[22] Filed: Oct. 24, 1986

[30] Foreign Application Priority Data

Oct. 31, 1985 [JP] Japan ..... 60-242860

[51] Int. Cl.[4] ..... A63B 53/04

[52] U.S. Cl. ..... 273/169; 273/173

[58] Field of Search ..... 273/169, 171, 167 R, 273/167 F, 172, 173, 174

[56] References Cited

U.S. PATENT DOCUMENTS 1,678,637 7/1928 Drevitson ..... 273/169

4,540,178 9/1985 Johnson et al. ..... 273/169

FOREIGN PATENT DOCUMENTS 59-16670 2/1984 Japan ..... 273/169

*Primary Examiner*—George J. Marlo

*Attorney, Agent, or Firm*—Armstrong, Nikaido, Marmelstein & Kubovcik

[57] ABSTRACT

A club-head for a golf club includes a hitting portion (11) having a front surface (11*a*) for hitting a golf ball, a rear surface (11*b*), a sole surface (11*c*) and heel and toe ends (11*d*, 11*e*), and a hosel portion (12) extending obliquely upward from the heel end (11*d*) of the hitting portion. The hitting portion (11) comprises a main body (13) made of a fiber-reinforced plastic for defining at least a part of the front and rear surfaces (11*a*, 11*b*) of the hitting portion. A metal sole member (14) having a specific gravity greater than that of the main body (13) is integrally joined to the main body (13) along the underside of the main body for defining at least the sole surface (11*c*) of the hitting portion (11). A reinforcing plate (19) is fitted at the lower end portion thereof into the sole member (14) and extends upwardly from the sole member into the main body (13) substantially in parallel to the front surface (11*a*) of the hitting portion (11). The reinforcing plate (19) has a specific gravity less than that of the sole member (14) and a strength greater than that of the main body (13).

3 Claims, 5 Drawing Figures

GOLF CLUB HEAD

BACKGROUND OF THE INVENTION

1. Field of the Invention

The present invention relates to a club-head for a golf club and, more particularly, to an improvement of a club-head having a hitting portion which includes a main body made of a fiber-reinforced plastic and a metal sole member integrally fixed to the main body along the underside of the main body.

2. Description of the Related Arts

Recently, a club-head has been used in which a hitting portion provided at the heel thereof with a hosel or neck portion for connecting a shaft consists of a main body made of a fiber-reinforced plastic for hitting a ball at the front surface thereof and a sole member made of a metal is integrally joined to the main body along the underside thereof. The club-head having such a construction has a drawback in that the main body is apt to be exfoliated from the sole member upon impact with a golf ball.

U.S. patent application No. 840,795 filed by the present applicant on Mar. 18, 1986, discloses one kind of the above-mentioned club-head wherein the back weight plate made of a heavy metal is attached to or embedded in the rear surface of the main body above the sole member. It has known that the club-head having such a construction can increase a flight distance of a golf ball hit by the head because the heavy back weight plate can most efficiently serve the main body to effect a repulsion action on the golf ball. But, the club-head having such a construction also has the drawback in that the main body is apt to be exfoliated from the sole member upon impact with a golf ball.

U.S. patent application No. 854,626 filed by the present applicant on Apr. 22, 1986, discloses another kind of the above-mentioned club-head wherein the weight member is embedded in the main body and connected to the sole member through one or more connecting members. In this construction, when the heavy weight member is arranged between the front and rear surfaces of the hitting portion of the club-head, the thickness of the main body between the front surface of the hitting portion of the club-head and the weight member is decreased, and thus, the repulsion action of the head against the golf ball and depth of the center of gravity of the head are decreased. On the other hand, when the heavy weight member is located at the rearmost position of the hitting portion of the club-head, the head has a drawback in that the main body is apt to be exfoliated from the sole member.

SUMMARY OF THE INVENTION

Accordingly, it is an object of the present invention to provide a club-head which can prevent exfoliation of the main body made of a fiber-reinforced plastic from the sole member made of a metal, while maintaining a good repulsion performance of the head.

The object of the present invention can be achieved by the provision of a club-head for a golf club including a hitting portion having a front surface for hitting a golf ball, a rear surface, a sole surface, and heel and toe ends, and a hosel portion extending obliquely upward from the heel end of the hitting portion, the hitting portion comprising: a main body made of a fiber-reinforced plastic for defining at least a part of the front and rear surfaces of the hitting portion; a metal sole member having a specific gravity greater than that of the main body and integrally joined to the main body along the underside of the main body for defining at least the sole surface of the hitting portion; and a reinforcing plate having a lower end portion fitted into the sole member and extending upwardly from the sole member into the main body substantially in parallel to the front surface of the hitting portion, the reinforcing plate having a specific gravity less than that of the sole member and a strength greater than that of the main body.

In the club-head according to the present invention, the main body is reinforced by the reinforcing plate, and the exfoliation of the main body from the sole member can be prevented by the reinforcing plate fitted into the sole member and the main body. Further, since the reinforcing plate has a specific gravity less than that of the sole member and a strength greater than that of the main body, it is possible to avoid the decrease of the repulsion performance of the hitting portion of the head against the golf ball.

In the preferred embodiment of the present invention, the hitting portion is provided, at the rear surface thereof, with a weight plate integrally fixed to the main body and having a specific gravity greater than that of the main body. The weight plate may be attached to or embedded in the rearside of the main body.

BRIEF EXPLANATION OF THE DRAWINGS

The foregoing and other objects and advantages of the present invention will be better understood from the following description with reference to the preferred embodiments illustrated in the drawings; wherein.

DESCRIPTION OF THE PREFERRED EMBODIMENTS

Figure 1:
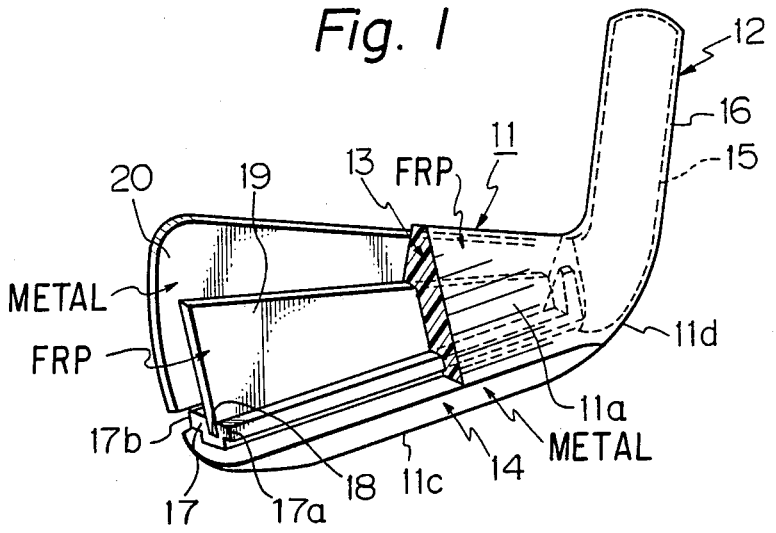
FIG. 1 is a partially broken-away perspective view of the club-head according to one embodiment of the present invention.
Figure 2:
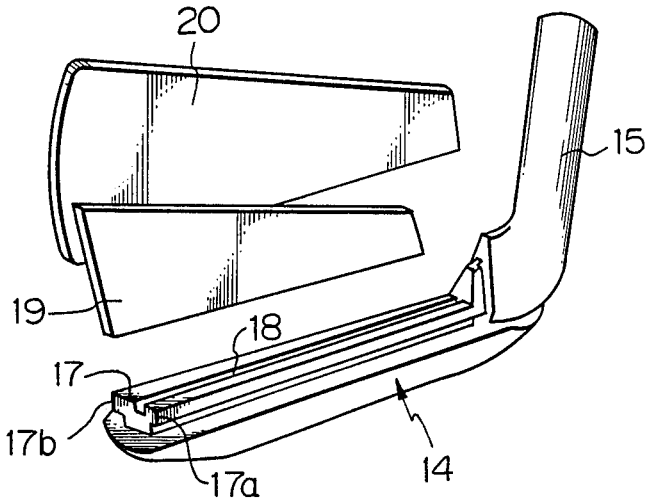
FIG. 2 is an exploded perspective view of the main parts of the club-head shown in FIG. 1.
Figure 3:
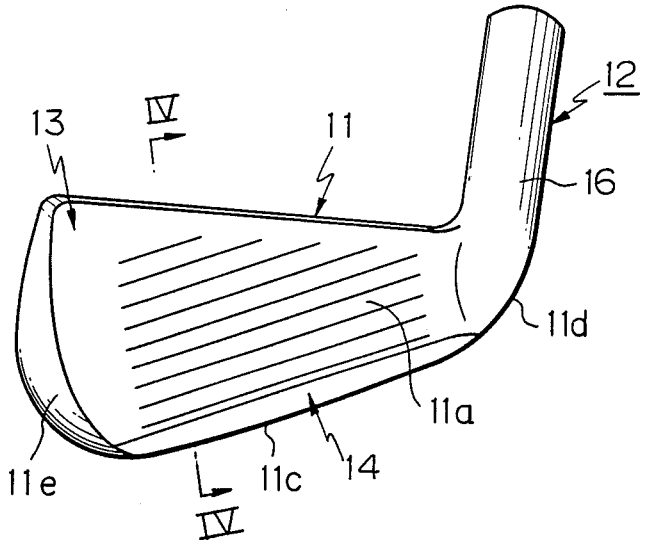
FIG. 3 is a perspective view of the club-head shown in FIG. 1.
Figure 4:
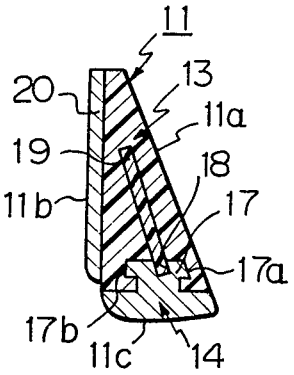
FIG. 4 is a sectional view of the club-head taken along the line IV—IV in FIG. 3.

FIGS. 1 to 4 illustrate a first embodiment of the present invention applied to a club-head for an iron golf club. As shown in FIGS. 1, 3, and 4, the club-head comprises a hitting portion 11 and a hosel portion 12. The hitting portion 11 has a front surface 11*a* for hitting a golf ball (not shown), a rear surface 11*b*, a sole surface 11*c*, a heel end 11*d*, and a toe end 11*e*. The hosel portion 12 extends obliquely upward from the heel end 11*d* of the hitting portion 11.

As shown in FIGS. 1, 3 and 4, the hitting portion 11 comprises a main body 13 which, in this embodiment, defines the front surface 11*a*, a part of the rear surface 11*b*, and heel and toe ends 11*d* and 11*e* of the hitting portion 11. The main body 13 is made of a fiber-reinforced plastic, such as a plastic reinforced by carbon fibers, glass fibers, aramid fibers, boron fibers, or compositions thereof. The plastic also may be mixed with whiskers to further improve the strength thereof.

As shown in FIGS. 1, 3 and 4, a sole member 14 for defining the sole surface 11*c* of the hitting portion 11 is integrally fixed to the main body 13. The sole member 14 extends along the underside of the main body 13 between the heel and toe ends 11*d* and 11*e* of the hitting portion 11, and is made of a metal, such as steel, stainless steel, brass, aluminum alloy, titanium alloy, or the like. Preferably, the material of the sole member 14 is selected so that the main body 13 has a specific gravity less than that of the sole member 14.

As shown in FIGS. 1 to 3, the hosel portion 12 comprises a metal core 15 made of the same material as that of the sole member 14 and formed in one piece therewith. The metal core 15 has at the top end thereof a hole (not shown) for receiving the tip end of a club shaft (not shown). The outer periphery of the metal core 15 is enveloped with the outer cover 16, which is made of the same material as that of the main body 13 and formed integrally therewith.

As shown in FIGS. 1, 2 and 4, the upperside of the sole member 14 is formed integrally with a ridge 17 projecting upwardly and extending substantially in parallel to the sole surface 11*c* of the hitting portion 11 between the vicinity of the heel end 11*d* and the vicinity of the toe end 11*e*. The upper end of the ridge 17 is formed integrally with opposite ribs 17*a* and 17*b* projecting toward the front and rear surfaces 11*a* and 11*b* of the hitting portion 11, respectively. The ridge 17 is embedded in the main body 13, as best shown in FIG. 4, when the main body 13 is formed by molding, and thus the strength of the connection between the main body 13 and the sole member 14 is increased.

As best shown in FIGS. 1 and 4, a groove 18 is formed in the upper end surface of the ridge 17 of the sole member 14 and extends between the vicinity of the heel end 11*d* and the vicinity of the toe end 11*e* of the hitting portion 11. A reinforcing plate 19 extending between the vicinity of the heel end 11*d* and the vicinity of the toe end 11*e* of the hitting portion 11 is fitted at the lower end portion thereof into the groove 18 of the ridge 17 of the sole member 14. The reinforcing plate 19 also extends upwardly from the sole member 14 into the main body 13, substantially in parallel to the front surface 11*a* of the hitting portion 11. The top edge of the reinforcing plate 19 extends downwardly from the vicinity of the toe end 11*e* toward the vicinity of the heel end 11*d* of the hitting portion 11, substantially in parallel to the top edge of the main body 13.

The material for the reinforcing plate 19 is selected so that it has a specific gravity less than that of the sole member 14 and a strength greater than that of the main body 13. Preferably, the reinforcing plate 19 is made of a laminated plastic reinforced by carbon fibers, glass fibers, aramid fibers, or compositions thereof, or is made of ceramics.

As shown in FIGS. 1, 2 and 4, a weight plate 20 for defining the rear surface 11*b* of the hitting portion 11 is integrally fixed to the main body 13 by an adhesive or screws (not shown). The weight plate 20 is made of a heavy material, such as iron, stainless steel, brass, lead, or an epoxy resin mixed with a heavy metal powder, so that it has a specific gravity greater than that of the main body 13.

The main body 13 of the above mentioned club-head is produced by injection molding or compression molding integrally with the sole member 14 and the reinforcing plate 19 fitted into the groove 18 of the ridge 17 of the sole member 14, which are located in place within the mold (not shown). The weight plate 20 also may be located in place within the mold and the main body 13 may be molded integrally with the weight plate 20.

In the above-mentioned club-head according to the present invention, the main body 13 is reinforced by the reinforcing plate 19, and the exfoliation of the main body 13 from the sole member 14 can be prevented by the reinforcing plate 19 fitted into the sole member 14 and the main body 13. Further, since the reinforcing plate 19 has a specific gravity less than that of the sole member 14 and a strength greater than that of the main body 13, it is possible to prevent the decrease of the repulsion performance of the hitting portion 11 of the club-head against the golf ball.

Further, in the above-mentioned embodiment, the weight member 20 is located at the rearmost part of the main body 13, and accordingly, the thickness of the main body 13 with the reinforcing plate 19 between the weight plate 20 and the front surface 11*a* of the hitting portion 11, and the depth of the center of gravity of the head from the front surface 11*a* of the hitting portion 11, are increased. As a result, the repulsion performance of the hitting portion 11 of the head against the golf ball is increased, and accordingly, the distance of the flight of the ball is increased, and a "gear action" produced between the hitting portion 11 and the golf ball is increased, and thus the direction of flight of the ball is improved.

Figure 5:
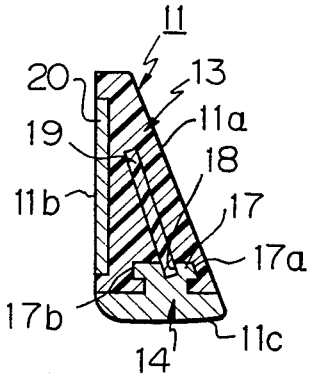
FIG. 5 is a sectional view of the club-head illustrating another embodiment of the present invention and corresponding to FIG. 4.

FIG. 5 shows a second embodiment of the present invention. In FIG. 5, constituents of the club-head corresponding to those of the above-mentioned embodiment are denoted by the same reference numerals as those used in FIGS. 1 to 4, respectively. In this embodiment the weight plate 20 is embedded in the rearside of the main body 13 so as to define a part of the rear surface 11*b* of the hitting portion 11.

Although particular embodiments of the present invention have been described, it will be understood, of course, that the present invention is not limited thereto, since modifications can be made by those skilled in the art in the light of the foregoing teachings. For example, the ridge 17 of the sole member 14 in the above-mentioned embodiment may be omitted and the groove 18 may be formed in the upper surface of the sole member 14. Further, the weight member 20 may be connected to the sole member 14 through one or more connecting members passing through the main body 13.

I claim:

1. A club-head for a golf club including a hitting portion having a front surface for hitting a golf ball, a rear surface, a sole surface and heel and toe ends, and a hosel portion extending obliquely upward from said heel end of said hitting portion, said hitting portion comprising:

a main body made of a fiber-reinforced plastic for defining at least a part of said front and rear surfaces of said hitting portion;

a metal sole member having a specific gravity greater than that of said main body and integrally joined to said main body along the underside of said main body for defining at least said sole surface of said hitting portion; and a reinforcing plate having a lower end portion fitted into said sole member and extending upwardly from said sole member into said main body substantially in parallel to said front surface of said hitting portion, said reinforcing plate having a specific gravity less than that of said sole member and a strength greater than that of said main body.

2. A club-head according to claim 1, wherein the upperside of said sole member is formed integrally with a ridge projecting upwardly and extending between the vicinity of said heel end and the vicinity of said toe end of said hitting portion, said ridge being formed with a groove for receiving said lower end portion of said reinforcing plate.

3. A club-head according to claim 1, wherein said hitting portion is provided at said rear surface thereof with a weight plate integrally fixed to said main body and having a specific gravity greater than that of said main body.

* * * * *